US009737448B2

(12) United States Patent
Farmer

(10) Patent No.: US 9,737,448 B2
(45) Date of Patent: Aug. 22, 2017

(54) ELEVATING MANUAL WHEELCHAIR

(71) Applicant: Jerome C. Farmer, Del Mar, CA (US)

(72) Inventor: Jerome C. Farmer, Del Mar, CA (US)

( * ) Notice: Subject to any disclaimer, the term of this patent is extended or adjusted under 35 U.S.C. 154(b) by 0 days.

(21) Appl. No.: 14/927,691

(22) Filed: Oct. 30, 2015

(65) Prior Publication Data

US 2016/0120715 A1 May 5, 2016

Related U.S. Application Data

(60) Provisional application No. 62/073,958, filed on Nov. 1, 2014.

(51) Int. Cl.
*A61G 5/10* (2006.01)

(52) U.S. Cl.
CPC ..... *A61G 5/1059* (2013.01); *A61G 5/101* (2013.01); *A61G 5/1018* (2013.01); *A61G 5/1035* (2013.01); *A61G 5/1089* (2016.11)

(58) Field of Classification Search
CPC .. A61G 5/1013; A61G 5/1018; A61G 5/1035; A61G 5/101; A61G 5/1005; A61G 5/104; A61G 5/1059
See application file for complete search history.

(56) References Cited

U.S. PATENT DOCUMENTS 284,705 A 9/1883 Allison
287,789 A 11/1883 Abbogast
438,034 A 10/1890 Lovell
441,520 A 11/1890 Pew
462,598 A 11/1891 Kitrell
468,569 A 2/1892 Vadjunes
480,789 A 8/1892 Parish
481,196 A 8/1892 Horn
500,765 A 7/1893 Hanna
509,600 A 11/1893 Regain
521,141 A 6/1894 Regain
561,369 A 6/1896 Johnson
586,545 A 7/1897 Taylor
589,947 A 9/1897 Novola
2,181,420 A * 11/1939 Everest ..... A61G 5/023 280/250
2,847,058 A * 8/1958 Lee ..... A61G 5/022 188/74
4,380,343 A * 4/1983 Lovell ..... A61G 5/023 280/250
4,625,984 A * 12/1986 Kitrell ..... A61G 5/023 280/250
4,732,402 A * 3/1988 Lambert ..... A61G 5/023 280/250.1
4,758,013 A * 7/1988 Agrillo ..... A61G 5/023 192/94
4,807,897 A * 2/1989 Schultz ..... A61G 5/14 280/250
5,037,120 A * 8/1991 Parisi ..... A61G 5/022 280/250.1
5,201,087 A * 4/1993 Wickham ..... A61G 5/00 280/647

(Continued)

*Primary Examiner* — Hau Phan
*Assistant Examiner* — Jacob Meyer
(74) *Attorney, Agent, or Firm* — Dinsmore & Shohl LLP

(57) ABSTRACT

A wheelchair apparatus is provided for raising and lowering a user of the wheelchair, while allowing the user to manually move the wheelchair at any height.

13 Claims, 7 Drawing Sheets

(56) References Cited

U.S. PATENT DOCUMENTS

| | | | | |
|---|---|---|---|---|
| 5,211,414 | A * | 5/1993 | Galumbeck | A61G 5/022 180/907 |
| 5,401,044 | A * | 3/1995 | Galumbeck | A61G 5/022 188/2 F |
| D368,243 | S * | 3/1996 | Nestor | D21/128 |
| 5,601,302 | A * | 2/1997 | Beard | A61G 5/1059 280/250.1 |
| 5,609,348 | A * | 3/1997 | Galumbeck | A61G 5/023 280/250.1 |
| 6,409,195 | B1 | 6/2002 | Adams | |
| 6,715,780 | B2 | 4/2004 | Schaeffer et al. | |
| 6,793,232 | B1 * | 9/2004 | Wing | A61G 5/006 280/304.1 |
| 6,851,751 | B1 | 2/2005 | Romero et al. | |
| 7,077,416 | B2 * | 7/2006 | Duarte | A61G 5/023 280/304.1 |
| 7,900,945 | B1 | 3/2011 | Rackley | |
| 8,398,108 | B2 * | 3/2013 | Andrews | A61G 5/1059 280/250.1 |
| 9,044,369 | B2 * | 6/2015 | Goldish | A61G 5/14 |
| 9,101,520 | B2 * | 8/2015 | Goldish | A61G 5/14 |
| 2002/0149168 | A1 * | 10/2002 | Brown | A61G 5/1059 280/250.1 |
| 2006/0091663 | A1 | 5/2006 | Jackson et al. | |
| 2008/0111338 | A1 | 5/2008 | Ilan | |
| 2008/0133089 | A1 | 6/2008 | Bayomy et al. | |
| 2009/0174168 | A1 | 7/2009 | Pavlopoulos et al. | |
| 2011/0215540 | A1 | 9/2011 | Hunziker et al. | |

* cited by examiner

ELEVATING MANUAL WHEELCHAIR

CROSS-REFERENCE TO RELATED APPLICATIONS

This application claims priority to U.S. provisional patent application Ser. No. 62/073,958, filed Nov. 1, 2014, which is incorporated herein in its entirety.

FIELD OF THE INVENTION

The present invention relates generally to manually powered wheelchair apparatus.

BACKGROUND OF THE INVENTION

There are many electrically powered chairs that raise the seat to different heights. And there are manual chairs that allow users to apply manual forces to move the chairs rather than by simply flipping on a power switch. Some manual chairs let a person stand and move in a standing position.

A manual chair has many physical and emotional advantages over a power chair. Physical movement benefits the cardiovascular, muscular and respiratory systems. Manually turning a wheel creates a direct relationship between your body and your motion, like riding a bike. The physical device reacts instantaneously to your actions. It provides a more dynamic feeling than moving a switch and being propelled by a motor.

The benefits of changing heights include the basic emotional advantage of looking eye-to-eye with standing people. A user can pull up to any table, and sit at the same height as anyone else, even if they are on stools. A user can reach objects in cabinets and closets just like a standing person. A user can cook and do other tasks at appliances designed for standing people, so homes do not have to be renovated. Parents in wheelchairs can be higher than their children. And children in wheelchairs can be raised to a level that makes it easier for the parents to feed, clean and take care of them.

SUMMARY OF THE INVENTION

This invention combines the physical advantages of a manual chair with the benefits of being able to rise much higher than a regular chair.

This invention also makes transfers from the chair much easier. To move the user from the wheelchair to another object, the user, nurse or caregiver can raise the chair above the object to which the user is moving, whether it is a bed, toilet, sofa, hospital examination table, etc. Then the transfer can be done with the user's body moving downward. The user's center of gravity will be lowering, requiring less physical exertion from the user, nurse, or caregiver. When the user wants to return to the chair, the user, nurse or caregiver can lower the chair before the transfer. The wheelchair seat can be lowered below the level of the object the user is on. Thus, all transfers can be done in a downward direction, reducing physical strain on the user, nurse or caregiver. This invention may also have an anti-tip mechanism to provide extra stability, allowing the wheelchair to be used on ramps and slopes. And a braking system attached to the front wheels may help the user move down ramps and slopes.

The present invention provides various embodiments of an apparatus that allows the user of a wheelchair to move himself around at different heights above the ground. The wheelchair includes a lower unit and an upper unit that serve as structural frames. The lower unit provides a structural frame with a front portion and a rear portion which may connect a front ground wheel assembly, a rear ground wheel assembly, casters, and anti-tipping devices. The front ground wheel assembly includes a pair of front ground wheels and is attached to the front portion of the lower unit. The rear ground wheel assembly includes a pair of rear ground wheels and is attached to the rear portion of the lower unit. The upper unit provides a structural frame to connect a seat, a backrest, two footrests, two armrests, and manual devices for moving the wheelchair.

A vertical lift system coupled to both the lower unit and upper unit keeps them aligned vertically and provides structural support between them. The vertical lift system may change its shape, increasing its vertical height. The lower unit always stays on the ground with the ground wheel assemblies touching the ground, while the upper unit rises as the vertical lift system increases its vertical dimension. The upward motion of the upper unit is in a generally vertical direction, but may be designed with a slight longitudinal angle. In one embodiment of the invention, a scissor lift is used as the vertical lift system, to raise and lower the upper unit. Alternatively, the vertical lift system between the lower unit and upper unit may be a jack or a telescoping device that is mounted on the lower unit and fastened underneath the upper unit.

A manual propulsion system is provided to enable a user sitting in the wheelchair to move the wheelchair around. The manual propulsion system may include two manual devices rotatably attached to the upper unit and coupled to the rear ground wheel assembly. The two manual devices may be a large hand-turned wheel at each side of the seat. In one embodiment, the user turns hand wheels mounted to the upper unit on each side of the user. Because the hand wheels are attached to the upper unit, they stay in the same position relative to the user at any height. So the user is able to reach and rotate the hand wheels at any height. The hand wheels may be connected to sprockets or barrels that turn a system of chains connected to sprockets or barrels on the rear ground wheels. When the user rotates the hand wheels, it causes the rear ground wheels to rotate so that the wheelchair moves around.

In an alternative embodiment, levers may be used instead of hand wheels.

In another embodiment, the invention may use belts or cables instead of chains to transfer the user's manual force to the rear ground wheels. These belts, cables or chains may be kept at a constant tension by being mounted on tension arms around sprockets or barrels. The tension arms include an assembly of pivotally connected bars that change their relative angle to each other as the upper unit rises or lowers. The sprockets and barrels share a common axis with the pivotally connected bars.

Anti-tip devices may extend laterally from the lower unit. These may be wheels connected to bars that are either permanently mounted to the lower unit or attached to the lower unit in a manner that allows movement. In one embodiment, two anti-tip devices are attached to the front portion of the lower unit, one on the right side and the other one on the left side, and the anti-tip devices consist of small wheels connected to curved bars that move in a curved motion along a guide track between a retracted position and an extended position. In the retracted position, the small anti-tip wheels are in a location generally above the front ground wheels. In the extended position, the anti-tip wheels are near the ground or touching the ground in a position in front of the front ground wheels.

In one embodiment of the invention, there are two switches near the armrests. One switch controls the height of the wheelchair and the other switch is a manual override of the default positions of the anti-tip wheels. The default position of the anti-tip wheels may be extended when the wheelchair's seat is raised above a specified height, and retracted when seat is below this height. In other embodiments the control of the height and anti-tip wheels may be done manually with levers, pumps or wheels. Hand brakes, similar to bicycle brakes, may also be used to brake the front ground wheels using hand controls mounted near the armrests. The braking cable may be routed from the upper unit to the lower unit next to the tension arms or the scissor lift, and routed beside casters on the front ground wheels.

BRIEF DESCRIPTION OF THE DRAWINGS

Other objects, features and advantages of the invention will become apparent from the following description in conjunction with the accompanying drawings, wherein.

DETAILED DESCRIPTION OF THE INVENTION

The present invention provides a manual wheelchair apparatus for raising and lowering a chair, while allowing the person seated on the chair to move the chair at any height. In a normal wheelchair, the user's hands directly turn wheels that are on the ground. In the present invention, a separate manually powered propulsion system is provided which does not directly touch the ground. The propulsion system moves up and down with the seat of the wheelchair and is coupled to the rear ground wheels mechanically.

Figure 1:
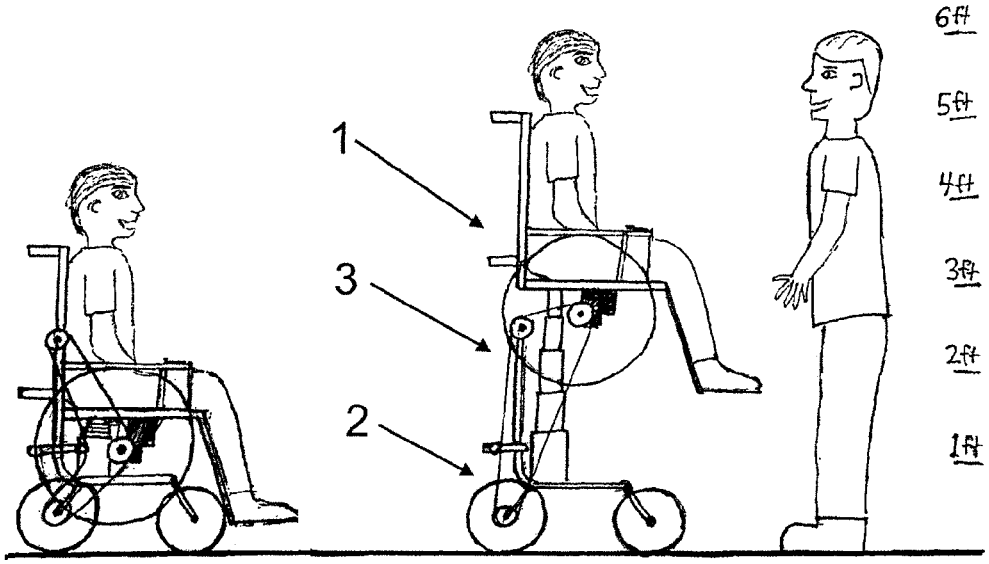
FIG. 1 is a side view of a manual wheelchair apparatus with variable height in accordance with an embodiment of the present invention, showing the wheelchair in both a lowered position and a raised position.

Referring to FIG. 1, a first embodiment of a wheelchair apparatus for manually propelling a wheelchair at different heights is shown. An upper unit 1 includes a seat, backrest, footrests, and armrests. A lower unit 2 includes four wheels touching the ground, namely two rear ground wheels and two front ground wheels. A vertical lift system 3 is between the upper unit and lower unit, and allows the wheelchair to change positions from a low position shown on the left of the figure to the high position in the middle of the figure; the wheel could also be used in intermediate positions. In this embodiment, the vertical lift system is a telescoping device which may be electric, hydraulic or human powered.

Figure 2:
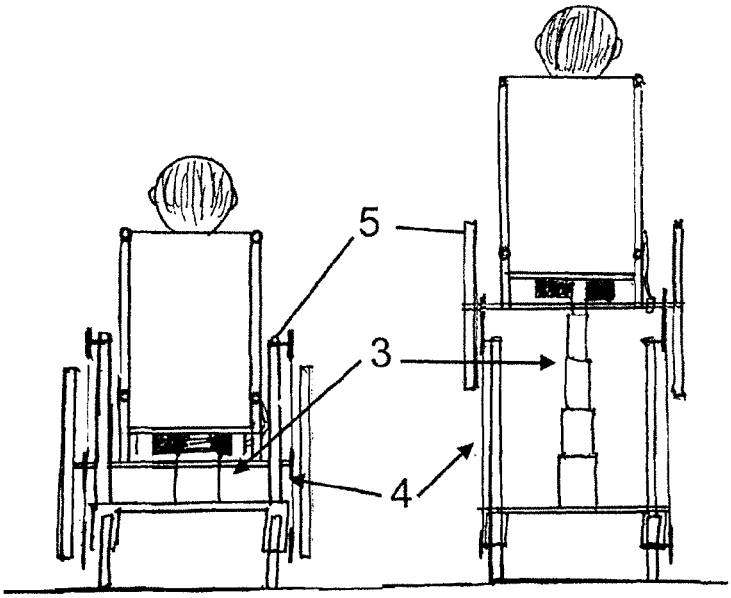
FIG. 2 is a rear view of a manual wheelchair apparatus with variable height, showing the wheelchair in both a lowered position and a raised position.

FIG. 2 shows the rear view of the same embodiment as in FIG. 1. Hand wheels 5 are attached to the upper unit, so they move vertically as the user and the seat moves. Thus, in total, the wheelchair has six wheels. The hand wheels are part of a manual propulsion system 4 that transfers the rotational force on the hand wheels to rotational force on the rear ground wheels. The mechanical transfer of force may be done by chains, cables or belts connected between the hand wheels on the upper unit and the rear ground wheels on the lower unit.

Figure 3:
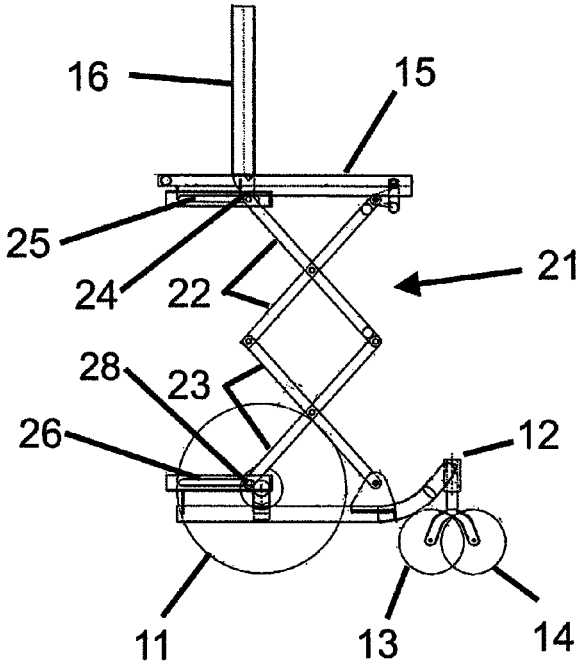
FIG. 3 is a cross sectional view, from the right side, displaying the left portion of a wheelchair apparatus, showing a scissor lift raising the upper unit.

FIG. 3 shows a scissor lift mechanism 21 being used as the vertical lift system. The upper unit includes a seat 15 and a backrest 16. The lower unit includes two rear ground wheels 11, one on the left side and one on the right side. The lower unit also is attached to two front ground wheels that are attached to casters 12, one front ground wheel on the left side and one front ground wheel on the right side. The front ground wheels can rotate 360 degrees, and FIG. 3 shows the front ground wheels rotated backwards 13 and the front ground wheels rotated forwards 14.

The scissor lift mechanism includes pairs of legs that can pivot on both ends. The embodiment of the apparatus in FIG. 3 shows a pair of upper scissor lift legs 22 and a pair of lower scissor lift legs 23. The lower end of the upper scissor lift legs are pivotally attached to the upper end of the lower scissor lift legs. One of the upper scissor lift legs is attached pivotally to the upper unit underneath the seat at a forward position. The other upper scissor lift leg has an upper scissor lift leg protuberance 24 at the end, which slides on an upper lift guide track 25. One of the lower scissor lift legs is attached pivotally to the lower unit between the center of the rear wheel and the caster. The other lower scissor lift leg has a lower scissor lift leg protuberance 28 at the end, which slides on a lower lift guide track 26. When the chair is raised, the scissor legs become more vertical, and the protuberances slide forward along their respective tracks. When the chair is lowered, the scissor legs become more horizontal, and the protuberances slide backwards along their respective tracks. The protuberances may also be part of a longitudinal bar between the scissor lift legs on the left side of the wheelchair and the scissor lift legs on the right side of the wheelchair.

Whether chains, belts, or cables are used, tension will have to be maintained as the wheelchair changes heights. This may be done by attaching chains, cables, or belts directly to the legs of the scissor lift. As the scissor lift moves up or down, the length of the scissor lift legs stay constant, and the distance of between the pivot points of the legs does not change. To keep the tension constant on the chains, cables or belts, the sprockets or the barrels must be centered on the pivot points of the scissor legs.

Figure 4:
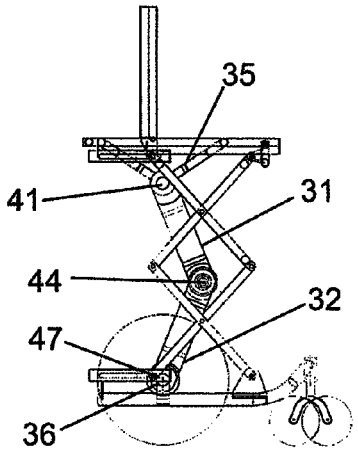
FIG. 4 is a cross sectional view, from the right side, displaying the left portion of a wheelchair apparatus, showing a system of tension arms to which chains may be mounted.

FIG. 4 shows an embodiment of tension arms including an upper tension arm 31 and a lower tension arm 32. The higher end of the upper tension arm is connected to the upper unit at the hand wheel hub 41 which is attached to the upper unit by the upper tension arm mount 35. The lower end of the upper tension arm is connected to the higher end of the lower tension arm at the dual sprocket hub 44. And the lower end of the lower tension arm is connected at the rear ground wheel hub 47 which is attached to the lower unit by the lower tension arm mount 36. Both the distance from the hand wheel hub 41 to the dual sprocket hub 44 and the distance from the dual sprocket hub 44 to the rear ground wheel hub 47 stay constant as the wheelchair raises or lowers. Thus chains, cables or belts will stay at the same tension if the sprockets of the chains, or the barrels of the cables or belts, are centered on the hubs.

Figure 5:
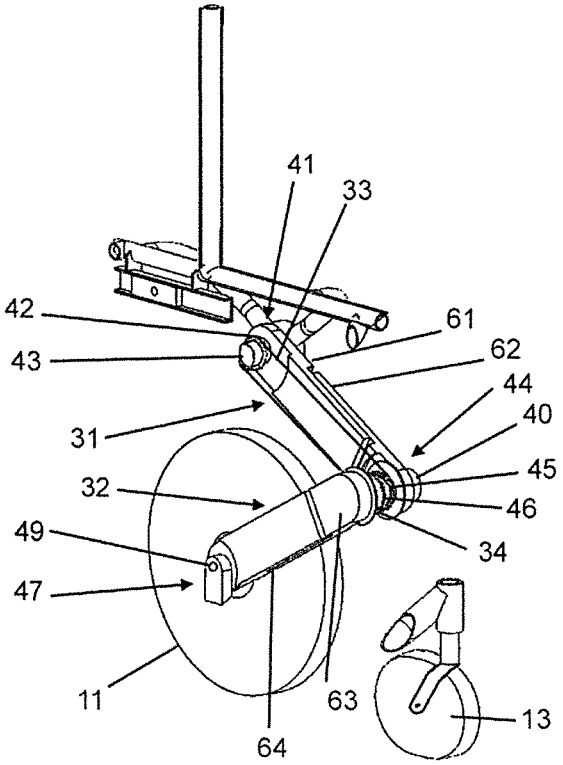
FIG. 5 is a cross sectional perspective view from a forward-right position, displaying the left portion of a wheelchair apparatus, showing a system of tension arms, chains, and sprockets to drive the rear ground wheel.

FIG. 5 shows an embodiment of the tension arms, in which each arm is comprised of two overlapping pieces aligned in parallel. The two pieces can slide along each other to adjust the length of the tension arms. The upper tension arm includes the upper tension piece 61 and the lower tension piece 62. The lower tension arm includes the upper tension piece 63 and the lower tension piece 64. At the hand wheel hub 41, the hand wheel sprocket 42 is attached to the hand wheel spindle 43. The dual sprocket hub 44 contains the dual spindle 40 to which both the upper chain dual sprocket 45 and the lower chain dual sprocket 46 are attached. At the rear ground wheel hub 47, the rear ground wheel sprocket (not visible in this figure, but located between the lower chain tension arm and the rear ground wheel) is attached to the rear ground wheel spindle 49. The upper chain 33 is connected between the hand wheel sprocket 42 and the upper chain dual sprocket 45. The lower chain 34 is connected between the lower chain dual sprocket 46 and the rear ground wheel sprocket. FIG. 5 only shows the tension arms on the left half of the wheelchair, but the same mechanism would be mirrored on the right half of the wheelchair. Instead of chains connected around sprockets, cables or belts may be used to be connected around barrels.

Figure 6A:
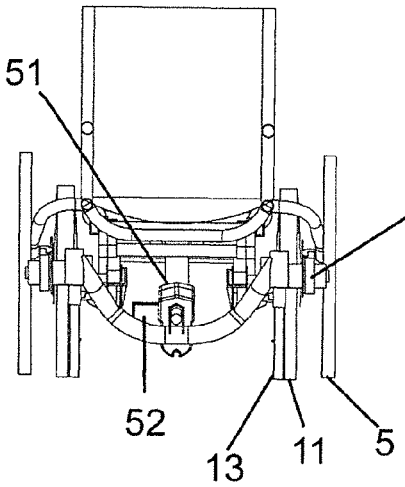
FIG. 6A is a schematic front view of a wheelchair apparatus in accordance with the present invention showing the wheelchair in a lowered position, and the footrests removed.

FIG. 6A shows an embodiment of the wheelchair apparatus from the front, in which the wheelchair has been lowered until the hand wheel 5 almost touches the ground. Turning the hand wheel 5 will turn the rear ground wheel 11. An actuator 51 is compressed, which lowered the scissor lift, thereby moving the upper unit and seat to their lowered position. In this embodiment, the actuator is powered by a battery 52.

Figure 6B:
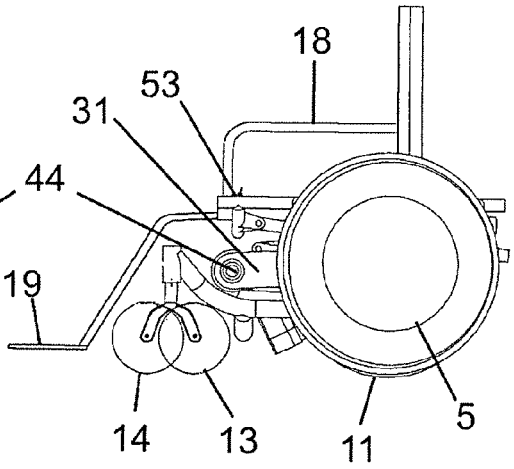
FIG. 6B is a schematic side view of a wheelchair apparatus in accordance with the present invention showing the wheelchair in a lowered position, and the footrests attached.

FIG. 6B shows the same embodiment of the wheelchair apparatus from the side, with the footrests added. Beneath the armrest 18 there is a height control switch 53. This switch may just have three settings: raise, lower, and stop. Because the wheelchair is lowered, only a small part of the rear ground wheel can be seen from the side.

Figure 7A:
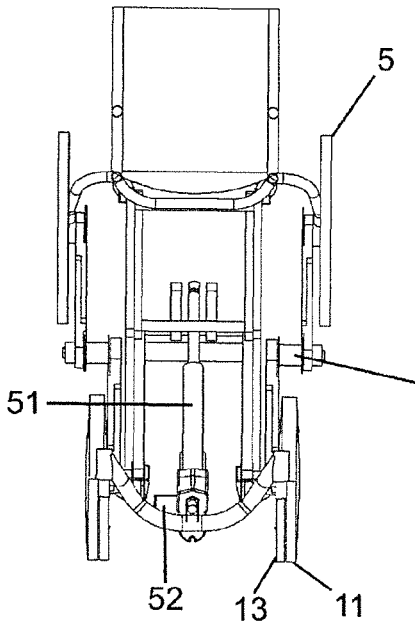
FIG. 7A is a schematic front view of a wheelchair apparatus in accordance with the present invention showing the wheelchair in a raised position, and the footrests removed.
Figure 7B:
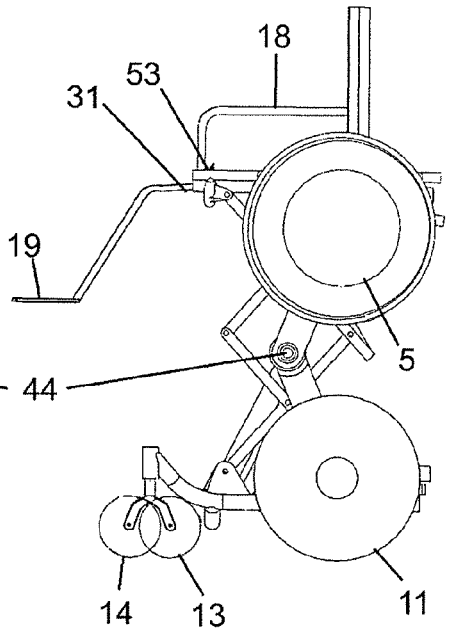
FIG. 7B is a schematic side view of a wheelchair apparatus in accordance with the present invention showing the wheelchair in a raised position, and the footrests attached.

FIGS. 7A and 7B show the same embodiment of the wheelchair apparatus as 6A and 6B, but in FIGS. 7A and 7B the wheelchair is raised. The actuator is extended, which raised the scissor lift, thereby separating the upper unit from the lower unit. Turning the hand wheels in the raised position drives the rear ground wheels in the same manner it did when the chair was lowered.

Figure 8:
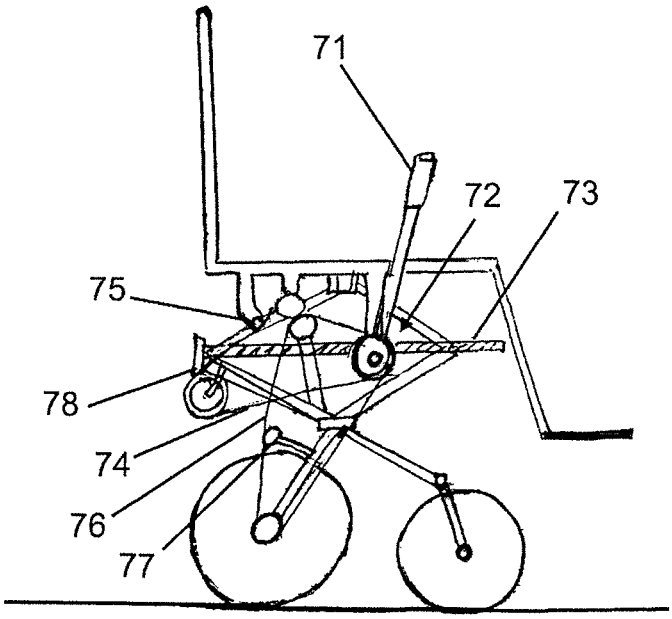
FIG. 8 is a side view of a manual wheelchair apparatus that uses a jackscrew as a lifting mechanism to raise and lower the upper unit.

FIG. 8 shows an alternative embodiment of the wheelchair apparatus using a jack 72 to raise and lower the wheelchair. There are two sets of chains, one chain that propels the chair, and a separate chain that adjusts the height of the chair. In this implementation, the jack is placed between the upper unit and lower unit. A lever 71 is used to turn a sprocket connected to the seat raising chain 74. The seat raising chain turns the bevel gear 78 that turns the jackscrew 73. Because the lever is attached to the upper unit, it moves with the user and seat. A seat raising chair tensioner 75 is connected to the upper unit and raises with the seat, but keeps tension on the seat raising chain. The lever may be shifted to turn a different sprocket connected to a rear ground wheel drive chain 76. A drive chain tensioner 77 is connected to the lower unit to keep tension on the rear ground wheel drive chain. Hand wheels could alternatively be used instead of levers. Belts or cables could be used instead of chains.

Figure 9:
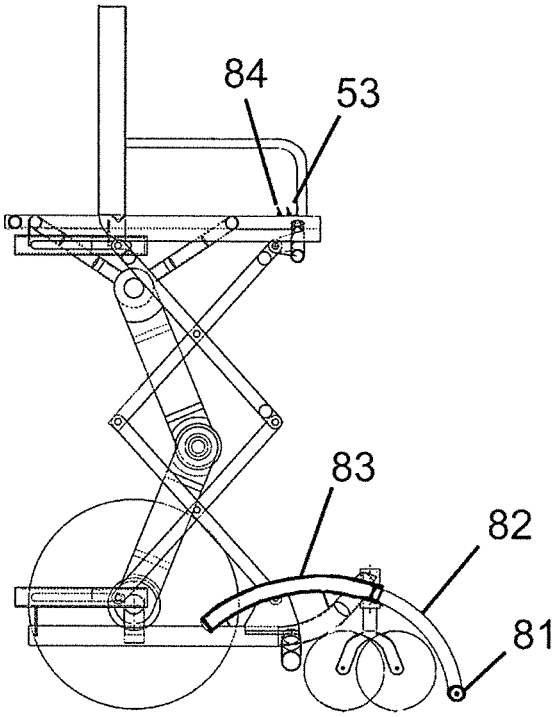
FIG. 9 is a cross sectional view of a wheelchair apparatus from the right side, displaying the left portion of the wheelchair, with the chair in a raised position, showing an anti-tip device extended.

FIG. 9 shows an embodiment of the invention with a retractable anti-tip device. The chair is in a raised position and the anti-tip device is extended. The anti-tip wheel 81 is connected to a curved anti-tip bar 82. The anti-tip bar is attached to an anti-tip guide track 83, and the anti-tip bar's position on the anti-tip guide track determines whether the anti-tip wheel is retracted near the caster or extended near the ground. An anti-tip control switch 84 is located on the upper unit near an arm rest.

Figure 10:
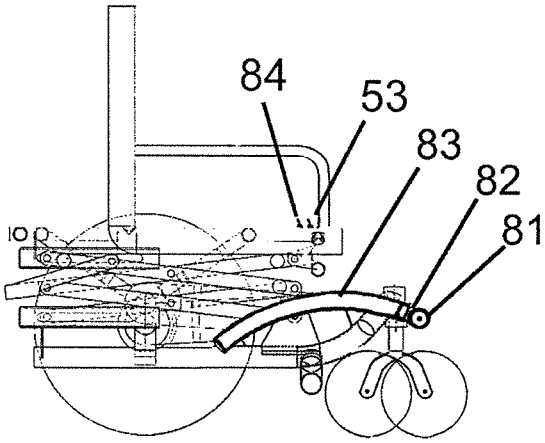
FIG. 10 is a cross sectional view of a wheelchair apparatus from the right side, displaying the left portion of the wheelchair, with the chair in a lowered position, showing an anti-tip device retracted.

FIG. 10 shows the same embodiment of the invention with the chair in a lowered position and the anti-tip wheel retracted. Limit switches or other electrical devices may be used to identify the height of the chair and the position of the anti-tip wheel, and an electrical system may be used to set the range of how high and low the chair can go. The position of the anti-tip wheel may be controlled by a combination of the height of the chair and the anti-tip control switch. For example, the default when the chair is lowered may be to fully retract the anti-tip wheels, and the default when the chair is raised may be to fully extend the anti-tip wheels. Any time the height of the chair is changed, the anti-tip wheels may be automatically moved to their default position. However the anti-tip control switch may override the default position. An accelerometer or gyroscope may be used to determine if the wheelchair is on a slope, and the anti-tip wheels may be automatically extended on any slope beyond a specified angle.

Figure 11:
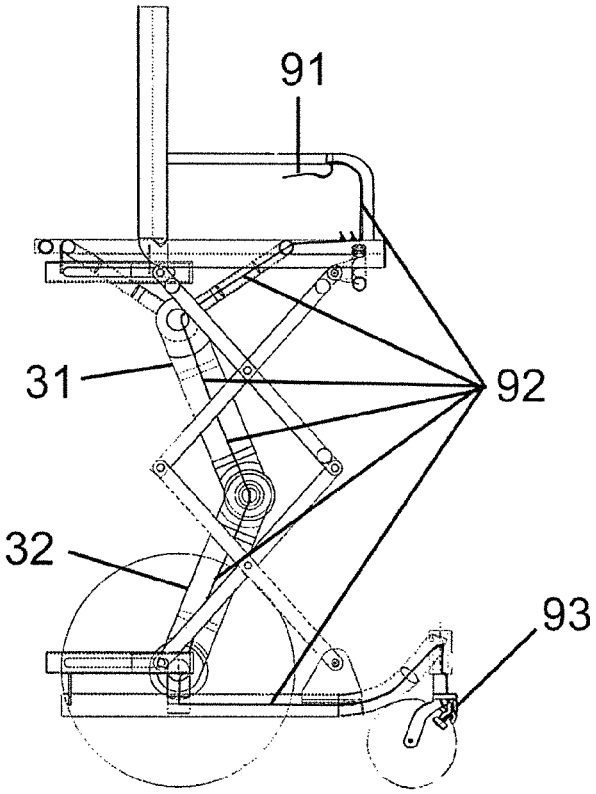
FIG. 11 is a cross sectional view of a wheelchair apparatus from the right side, displaying the left portion of the wheelchair, with the chair in a raised position, showing a braking system for the front wheels.

FIG. 11 illustrates a braking system that uses the tension arms to route a brake cable 92 from the upper unit to the lower unit. A hand-controlled brake handle 91 is attached to or near the armrest. The brake cable may follow the tension arms from the upper unit to the lower unit, so it does not become tighter or looser as the wheelchair changes heights. Alternatively, the brake cable may follow the legs of the scissor lift. When the brake cable reaches the lower unit, it is routed along the caster to a brake 93 connected to the front ground wheel. The brake may be connected to the rear ground wheel or to both front and rear ground wheels. As a further alternative, a brake may be provided on the hand wheel or lever such that the rear ground wheel is locked by the mechanical system coupling the rear ground wheel to the hand wheel or lever.

Figure 12:
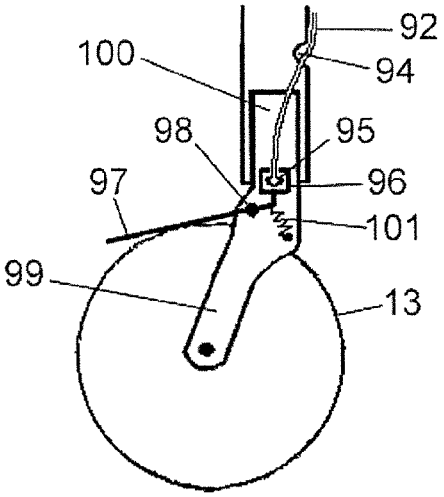
FIG. 12 is a cross sectional view of a braking system for the front wheels showing a cable going vertically through the wheel mount to a level above the wheel.

FIG. 12 shows a braking system in which the braking cable goes through a hole 94 in the structure of the lower unit directly above the wheel. The cable terminates at a round protuberance 95, which has the freedom to rotate laterally inside a cable connector 96. A lever 97 pivots on a braking hinge 98, which is mounted on the wheel mounting fork 99 connected to the front wheel. The hinge 98 has an axis parallel to the rotational axis of the wheel 13. When the wheel mounting stem 100 rotates, the cable connector rotates, but the cable does not. A spring 101 provides tension and prevents any braking from occurring when the user is not pulling the cable.

As will be clear to those of skill in the art, the various elements of the embodiments described herein may be combined in different combinations than shown. As a non-limiting example, the lift system from one embodiment may be used with the anti-tip wheels of another. The rear ground wheel assembly has been described herein as including a pair of rear ground wheels. The rear ground wheels may be entirely independent of each other and are still considered part of the rear ground wheel "assembly". The same applies to the front ground wheels.

Further, the embodiments of the present invention illustrated and discussed herein may be altered in various ways without departing from the scope or teaching of the present invention. It is the following claims, including all equivalents, which define the scope of the invention.

The invention claimed is:

1. A wheelchair apparatus comprising:

an upper unit including a structural frame and a generally horizontal seat mounted on the frame, the upper unit having a lowered position and a raised position, wherein the seat remains generally horizontal from the lowered position to the raised position;

a lower unit including a structural frame with a front portion and a rear portion, a rear ground wheel assembly including a pair of rear ground wheels attached to the rear portion of the structural frame and a front ground wheel assembly including a pair of front ground wheels attached to the front portion of the structural frame;

a vertical lift system coupling the upper unit to the lower unit and operable to lift the upper unit from the lowered position to the raised position; and a manual propulsion system supported on the upper unit and coupled to the rear ground wheel assembly which enables a user sitting in the seat to rotate the rear ground wheels with the upper unit in the lowered position and in the raised position.

2. A wheelchair apparatus in accordance with claim 1, wherein the manual propulsion system includes two manual devices rotatably attached to the upper unit and coupled to the rear ground wheel assembly, and wherein the user rotates the manual devices to rotate the rear ground wheels when the upper unit is in the lowered position and the raised position.

3. A wheelchair apparatus in accordance with claim 2, wherein the manual devices attached to the upper unit are hand wheels.

4. A wheelchair apparatus in accordance with claim 1, wherein the vertical lift system comprises a telescoping device.

5. A wheelchair apparatus in accordance with claim 1, wherein the vertical lift system comprises a scissor lift.

6. A wheelchair apparatus in accordance with claim 1, wherein the vertical lift system comprises an actuator, the actuator being connected to both the lower unit and the upper unit by hinges and operable to cause the upper unit to move in a generally vertical direction.

7. A wheelchair apparatus in accordance with claim 2, wherein the manual propulsion system further comprises a system of chains, cables or belts for coupling the manual devices to the rear ground wheel assembly and transferring the rotation of the manual devices to the rear ground wheels causing the rear ground wheels to rotate.

8. A wheelchair apparatus in accordance with claim 7, wherein:

the manual propulsion system further comprises tension arms, the tension arms including an assembly of pivotally connected bars connected to the upper unit and the lower unit by hinges; and the system of chains, cables or belts are mounted on the assembly of pivotally connected bars by sprockets or barrels which share a common axis with the pivotally connected bars.

9. A wheelchair apparatus in accordance with claim 1, further comprising a retractable anti-tip device including an anti-tip guide track mounted to the lower unit, a curved anti-tip bar attached to the anti-tip guide track and an anti-tip wheel connected to the curved anti-tip bar, wherein the curved anti-tip bar is extendable downward and forward or retractable upward and backwards along the anti-tip guide track.

10. A wheelchair apparatus in accordance with claim 1, further comprising a braking system which is installed with a cable that extends from the upper unit through tension arms or the vertical lift system to the lower unit and then attaches to the front wheel assembly.

11. A wheelchair apparatus in accordance with claim 10, wherein the braking system comprises:

a lever mounted on the front wheel assembly, the lever being pivotally supported on an axis parallel to a rotational axis of one of the front wheels;

the lower unit having a hole defined therein above the one of the front wheels, the braking cable extending through the hole in the lower unit above the one of the front wheels and extending vertically towards one end of the lever;

the one end of the lever connected to the cable by a component operable to isolate the cable from lateral rotations of the one of the front wheels; and an end of the lever opposite the end connected to the cable operable to produce a braking force against the wheel.

12. A wheelchair apparatus in accordance with claim 1, wherein the seat includes a backrest, a pair of footrests and a pair of armrests.

13. A wheelchair apparatus in accordance with claim 1, wherein the front ground wheels are attached to casters.

* * * * *